US005093069A

United States Patent [19]

Mellem et al.

[11] Patent Number: 5,093,069

[45] Date of Patent: Mar. 3, 1992

[54] PROCESS AND DEVICE FOR THE PRODUCTION OF MINERAL WOOL NONWOVEN FABRICS ESPECIALLY FROM ROCK WOOL

[75] Inventors: Joachim Mellem, Schriesheim; Klemens Hirschmann, Ilvesheim; Heinz-Juergen Ungerer, Viernheim; Hans Furtak, Speyer, all of Fed. Rep. of Germany

[73] Assignee: Grünzweig + Hartmann AG, Ludwigshafen, Fed. Rep. of Germany

[21] Appl. No.: 545,871

[22] Filed: Jun. 29, 1990

[30] Foreign Application Priority Data

Jun. 29, 1989 [DE] Fed. Rep. of Germany ..... 3921399

[51] Int. Cl.[5] ..... C04B 37/01; C03C 27/06; B32B 17/02

[52] U.S. Cl. ..... 264/510; 65/4.4; 65/9; 156/62.2; 156/62.4; 156/62.8; 264/518; 264/113; 425/81.1; 425/82.1; 425/83.1

[58] Field of Search ..... 264/510, 518, 113, 121; 425/81.1, 82.1, 83.1; 65/4.4, 9; 156/62.2, 62.4, 62.6, 62.8

[56] References Cited

U.S. PATENT DOCUMENTS

| | | | |
|---|---|---|---|
| 2,467,291 | 4/1949 | Brelsford et al. | 156/62.6 |
| 2,785,728 | 3/1957 | Slayter et al. | 156/62.6 |
| 2,897,874 | 8/1959 | Stalego et al. | 65/9 |
| 3,220,812 | 11/1965 | Underwood | 65/9 |
| 3,824,086 | 7/1974 | Perry et al. | 65/9 |
| 4,201,247 | 5/1980 | Shannon | 138/141 |
| 4,463,048 | 7/1984 | Dickson et al. | 428/218 |

FOREIGN PATENT DOCUMENTS

| | | |
|---|---|---|
| 236259 | 10/1964 | Austria . |
| 2118063 | 11/1971 | Fed. Rep. of Germany . |
| 1577775 | 4/1969 | France . |

*Primary Examiner*—Mary Lynn Theisen
*Attorney, Agent, or Firm*—Oblon, Spivak, McClelland, Maier & Neustadt

[57] ABSTRACT

In the continuous production of mineral wool nonwoven fabrics, fiber/gas/air mixtures (3, 4) produced by several shredding units (14 to 17) are directed onto collecting conveyor units (19, 21) with suction surfaces (c, d) running in a curve and being under suction pressure for the formation of a wool nonwoven fabric (25). In this case the arrangement is such that an imaginary suction surface, increasing in its size in the conveying direction, is assigned to each fiber/gas/air mixture formed by the individual shredding units (14 to 17), actually d is larger than c. As a result it is possible, in a space-saving method of construction and per collecting conveyor unit to produce mineral wool nonwoven fabrics from rock wool with constant suction pressure with bulk densities even under 25 kg/m$^3$ in good product quality. By series connection of several units or an oscillating deposit of an individual nonwoven fabric multilayer felt webs can further be formed.

19 Claims, 5 Drawing Sheets d > c f > e

PROCESS AND DEVICE FOR THE PRODUCTION OF MINERAL WOOL NONWOVEN FABRICS ESPECIALLY FROM ROCK WOOL

BACKGROUND OF THE INVENTION

1. Field of the Invention

The invention relates to a process and a device for continuous production of mineral wool nonwoven fabrics particularly from rock wool by depositing fibers on a collecting conveyor subjected to suction pressure. The invention also relates to processes for the continuous production of felt webs comprising several mineral wool nonwoven fabrics.

2. Discussion of Background

In the production of mineral wool nonwoven fabrics, e.g., from rock wool or glass wool, besides the shredding itself, the formation of the nonwoven fabric as such is an important process step. In this case, as is known, a fiber/gas/air mixture, produced by a shredding unit, for the separation of the fibers, is introduced into a boxlike so-called fall shaft, which in most cases on the bottom side exhibits a collecting conveyor acting as a sort of filter screen, which generally is designed in the form of a gas-permeable rotating plane conveyor belt. In this case under the conveyor belt there is a suction device, which produces a specific partial vacuum.

Now if the fiber/gas/air mixture—which can also contain a binder—strikes the collecting conveyor, the gas/air mixture is suctioned under the collecting conveyor acting as a filter, and the fibers are deposited on the conveyor as nonwoven fabric. On the other hand, if a fall shaft with several consecutively placed shredding units is used to obtain mineral wool nonwoven fabrics, which, in comparison with the first-mentioned device, have higher wool layers, i.e., higher weights per unit area, the already formed partial nonwoven fabric of each previous shredding unit represents an additional flow resistance in connection with each subsequent partial nonwoven fabric for the suction of the gas/air mixture. This means the more shredding units working together in a fall shaft, the higher the flow resistance in the conveying direction of the total nonwoven fabric, and thus the energy consumption of the suction device increases, with whose suction pressure the respective flow resistance must be overcome. To illustrate this principle, reference is made, for example, to U.S. Pat. No. 3,220,812.

Besides the increased energy consumption, such an entire nonwoven fabric formation has the decisive disadvantage that by the relatively high differential pressures resulting in this case between suction device and nonwoven fabric surface the mineral wool nonwoven fabric that is being formed can be compressed so that it leaves the fall shaft precompressed. As a consequence, it is not permissible to fall below preset minimum weights per unit volume of the entire mineral wool nonwoven fabric, i.e., weights per unit volume in wool nonwoven fabrics, e.g., from rock wool, under 25 kg/m$^3$ can hardly be produced with such devices.

Moreover, the nonwoven fabric formation many times does not proceed homogeneously, so that different weights per unit area can be distributed over the total surface of the nonwoven fabric. Further with such devices with a multiplicity of shredding units there is the disadvantage that with the requirement to produce a mineral wool nonwoven fabric with relatively high weight per unit area, possibly some shredding units must be cut off, as soon as the capacity of the suction device, i.e., its blower performance, is exceeded, to keep the fall shaft capable of functioning.

The circumstance that the nonwoven fabric thickness increases toward the outlet of the fall shaft and the rate of flow at constant suction pressure toward the outlet of the fall shaft decreases, has led in the usual fall shafts even to the suction areas being divided into several zones under the conveyor belt, in fact with increasing suction pressure in the conveying direction. But the problem of high differential pressures and thus the undesired precompressing of the entire nonwoven fabric was not solved with this measure.

SUMMARY OF THE INVENTION

Accordingly, one object of this invention is to provide a novel process and device with which it is possible continuously to produce mineral wool nonwoven fabrics, preferably from rock wool, with bulk densities even under 25 kg/m$^3$ in good product quality and with which also a reduction of the energy expenditure for the suction is achieved. It is another object of the invention to provide processes with which a continuous production of multilayer felt webs from the formed mineral wool nonwoven fabrics of low bulk density is perfectly possible.

Achievement of a bulk density under 25 kg/m$^3$ is made possible by providing a collecting conveyor having at least one area running in a curve. In this way it is achieved that with increasing forming nonwoven fabric thickness the available suction surface increases in its size. This is true especially with a curved surface, since here the developed length is greater than the horizontal of its perpendicular projection. The latter circumstance further means that with the use of several shredding units, the latter can be placed in a space-saving manner at the same distance from one another, and yet per unit in each case the available suction surfaces increase in the conveying direction. Here the function applies quite generally: suction surface $A = f(\zeta)$), in which ($\zeta$) represents the resistance coefficient of the respective mineral wool nonwoven fabric and depends mainly on its weight per unit area and the fiber fineness.

The basic condition for a pressure loss in a flow in this case is the following:

$$\Delta p = \zeta \frac{\rho}{2} w^2,$$

in which $\rho$ = density of the gas/air mixture (kg/m$^3$) and w = flow rate (m/s).

Now if it is assumed that both the volumetric rate of flow of each shredding unit and $\Delta$ p of the suction device are constant, the following relations result:

$$w_1 \times A_1 = w_2 \times A_2$$

$$\zeta_1 \times \frac{\rho}{2} + w_1^2 = \zeta_2 \times \frac{\rho}{2} \times w_2^2$$

$$w_2 = w_1.$$

From this it again follows that in the conveying direction the flow rate is reduced in proportion to the root of the ratio of the resistance coefficients, or to maintain the volumetric rate of flow, it holds true:

$$A_2 = A_1 \cdot \sqrt{\frac{\zeta_2}{\zeta_1}}$$

From this it further follows that the available suction surfaces could indeed also be designed plane, but which at constant suction pressure in the conveying direction would mean increasing distances of the shredding units and thus need for more space. But this recognized relationship represents—the novelty presupposed—an invention by itself.

The definition "imaginary suction surface," used in this connection is to be so understood that the individual suction zones are not divided in their design by partitions as in the prior art. Rather the latter occur because of the vertical projection of the, e.g., wedge-shaped geometry of the plane free jet bundles forming in the blast drawing process per shredding unit, and in this case the boundaries of the individual suction zones can overlap as a result of the turbulence in a fall shaft, but in this case it is essential that for each free jet projection surface in the conveying direction an increasing suction surface be available, by which, on the one hand, it is advantageously possible to keep the suction pressure constant in the collecting conveyor unit and on the whole to work with a smaller suction capacity. The latter measures again make possible a smaller wool layer per surface unit and thus the production of mineral wool nonwoven fabrics with relatively small bulk densities.

In this connection a device for production of a wool nonwoven fabric is indeed known from DE-OS 21 22 039, in which the fibers coming from a shredding unit strike a suction surface running in a curved manner, and indeed in the form of a suction drum rotating with a high speed (45 m/sec), but the actual nonwoven fabric formation does not take place here on the suction drum, since the latter has too high a peripheral speed, but in a downstream funnel-shaped so-called distributor, which has the same width as the suction drum. Since such known suction drums used in the area of the blast drawing process have a peripheral speed which corresponds more or less to the speed of the produced fibers, they do not serve for depositing the actual fiber nonwoven fabric but only for suction of the gas/air mixture. In this DE-OS 21 22 039 a fall shaft is also shown with several shredding units and two counterrotating drums. But in this case only consecutively placed shredding units are thought of, whose center lines lie in a vertical plane, to which again the two suction drums are placed symmetrically, and they work according to the same principle as the initially described single drums.

If in the device according to the invention only a gas-permeable collecting conveyor unit with at least one area running in a curve and for this purpose, at a distance from this area, a guide element, sealing with reference to the fall shaft is used, the guide element preferably is designed with its surface opposite the area running in a curve and movable in the conveying direction. Thus it is achieved that the wool nonwoven fabric being formed is better discharged.

Such a sealing guide element is necessary in any case to prevent the unauthorized escape of air and fibers from the fall shaft. The latter also applies to a discharge slot of the wool nonwoven fabric, for here the sealing must take place by the wool nonwoven fabric itself. But the sealing action of the nonwoven fabric is determined by its weight per unit volume, its restoring force and the cohesion force of the nonwoven fabric itself, so that, e.g., a nonwoven fabric with long elastic individual fibers is better able to fill a discharge slot than with the same slot width a nonwoven fabric with short individual fibers. On the other hand, the discharge slot cannot be arbitrarily selected narrow, since otherwise for a higher weight per unit area too great a precompression would occur. Therefore, it can be advantageous that the clearance between the guide element and the collecting conveyor unit be designed adjustable.

It can also be advantageous that, instead of the guide element, another collecting conveyor unit is provided, which then takes care of the question of sealing toward the fall shaft on the side of the originally provided guide element. With such an arrangement of two collecting conveyor units the inventive idea then comes fully to fruition. If three shredding units are assigned to this double unit, symmetry can be provided by locating the third shredding unit in the center between the double unit. Also in this case it can be useful that the slot provided between the collecting conveyor units for discharge of the nonwoven fabric be variable in its width.

If the discharge slot must be kept constant between the collecting conveyor units, e.g., for process engineering or design reasons, it is advantageously proposed to vary this constant slot by at least one element adjustable in its width downstream in the conveying direction, and this adjustable element advantageously can be a drivable roller or a drivable conveyor belt. Also for this purpose two drivable rollers or conveyor belts, arranged at an adjustable distance from one another, can be used.

These downstream elements, adjustable in the conveying direction are of great importance inasmuch as it must be possible with a device according to the invention to produce mineral wool nonwoven fabric with different weights per unit area. According to experience with usual fall shafts with several shredding units, and here especially with those that operate according to the blast drawing process, it has been shown that wool nonwoven fabrics with weights per unit volume in the area of discharge from the fall shaft can hardly be under about 25 kg/m$^3$ and, to avoid precompression, hardly be over 75 kg/m$^3$, since otherwise no usable and trouble-free processing is any longer possible. This corresponds to a layer variation of about 1:3, but a variation span of 1:12 and more is desired. In this connection, the discharge of nonwoven fabrics with relatively few layers impose particular requirements, since here the internal cohesion of the nonwoven fabric is the smallest. Such nonwoven fabrics therefore can be blown out with an unauthorized escape of air through the discharge slot, or with too great a suction pressure are barely separated from the collecting conveyor. Further it should be noted that with a possible failure of one unit of the four shredding units provided here only a third of the total weight per unit area reaches the one collecting conveyor unit, which also increases the requirements on the nonwoven fabric discharge. The adjustable elements for varying the slot width previously discussed especially contribute to meeting these requirements.

But other measures also help in taking these requirements into account. It can be advantageous to provide that the available suction surfaces of each collecting conveyor unit, especially in the area of the slot provided for discharge of the nonwoven fabric, are adjustable in their size. Further, at least before a downstream element one blow device can be provided, by which the forming nonwoven fabrics can be manipulated.

The device according to the invention offers the substantial advantage that for the deposit surfaces of the collecting conveyors relatively thin, perforated sheet metal pieces can be used, since they need not absorb any high surface loads; this means furthermore that otherwise statically necessary crosswise ribs with corresponding overall height can be eliminated, by which collecting conveyor surfaces smooth on both sides are obtained, which can easily be kept clean purely mechanically. This can advantageously take place by the combination of at least one elastic roller-shaped brush, which on the inside combs the perforation of a collecting conveyor with its same peripheral speed and at least one other roller-shaped brush, which cleans the outside surface with a substantially higher peripheral speed in comparison with the collecting conveyor. Thus a dry operation of the device according to the invention is advantageously possible, which in comparison with the prior art brings with it substantial processing and cost advantages, since in the prior art, the generally expensive wet/drying cleaning devices must be used to keep the perforation of the collecting conveyors free of possibly adhering fiber and binder residues.

The device according to the invention is suitable especially for the production of nonwoven fabrics from rock wool, which is produced according to the blast drawing process. But with this process so far it was hardly possible economically and reliably to produce nonwoven fabrics on the basis of rock wool with bulk densities below 25 kg/m$^3$. The blast drawing process, as is known, is marked by the fact that melt flows leave a crucible containing a mineral melt under the effect of gravity, flows which are shredded in a debiteuse under the effect of gases of a high flow rate flowing essentially parallel to the melt flows, are removed and cooled below the softening temperature. In this connection it can also be suitable with regard to the increasing deposit surfaces that the shredding units are placed inclined so that the fibers produced by the units strike the collecting surface at an inclination deviating from the vertical.

Further, it is advantageous if a rotationally symmetrical unit is selected as a collecting conveyor, i.e., at least one collecting conveyor unit is designed as a drum, and the suction pressure in each collecting conveyor unit should be adjustable by itself, so that it is easily possible to adjust to different operating conditions.

The second partial object of this invention is advantageously achieved by a process, in which for the continuous production of a felt web composed of several individual nonwoven fabrics the individual nonwoven fabrics coming from several devices according to the invention are deposited together on a running conveyor belt into a felt web.

As an alternative to this, it can also be advantageous to form a composite felt web from a single nonwoven fabric in which the latter is deposited on a running conveyor belt by an oscillating movement in a multilayer felt web.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
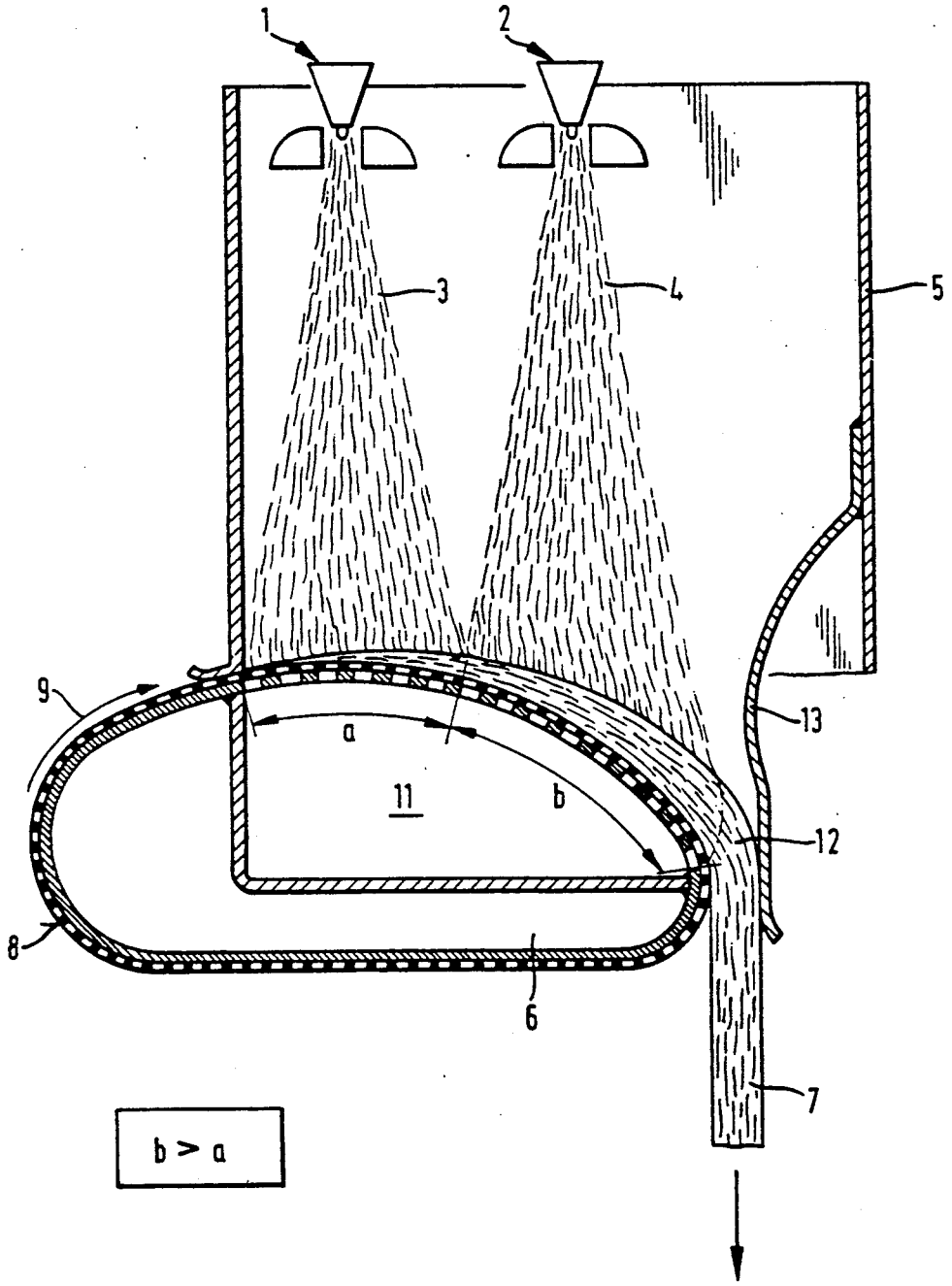
FIG. 1 is a diagrammatically simplified section through a first embodiment of a device according to the invention for the production of mineral wool nonwoven fabrics with two shredding units and one gas-permeable collecting conveyor, which in the area of the fiber deposit exhibits a suction surface running in a curve.

Referring now to the drawings, wherein like reference numerals designate identical or corresponding parts throughout the several views, and more particularly to FIG. 1 thereof two shredding units 1 and 2 operating according to the blast drawing process produce free jet bundles 3 and 4, approximately wedge-shaped in their geometry. The free jet bundles comprise a fiber/gas/air/binder mixture, and they are surrounded by a fall shaft 5 designed box-shaped. The lower end of fall shaft 5 is formed by a collecting conveyor unit 6, which has two suction surfaces, identified by "a" and "b," running in a curve, on which the fibers coming from shredding units 1, 2 are deposited into a wool nonwoven fabric 7. Collecting conveyor unit 6 exhibits a rotating perforated conveyor belt 8, which in the direction of arrow 9, the conveying direction, is driven by a motor (not represented in the drawing). Further, within collecting conveyor unit 6 a suction device, not represented, is provided, whose produced suction pressure is effective only in a suction chamber 11 placed under suction surfaces "a" and "b" running in a curve. Opposite suction surface "b," running in a curve, at a certain distance from it, a guide element 13, in the form of a piece of sheet metal, is provided, limiting a so-called discharge slot 12 and sealing opposite fall shaft 5, an element which is placed stationary in the present case.

The wedge-shaped geometry of the fiber free jet bundles 3, 4 is represented idealized in FIG. 1, although in practice so far in the fall shaft certain turbulences occur. Thus it can happen, e.g., in the usual fall shafts that for a few centimeters (about 2 to 10 cm) above the forming nonwoven fabric very strong crosscurrents occur, which are greater in amount than the average speed in the blower current, and which can lead to a deterioration of the fiber deposit by roll and hank formation. Corresponding to these crosscurrents the respective static pressures must also be distributed in the area up to about 10 cm above the forming nonwoven fabric. Thus, for example, pressure of about 40 mm/water column in comparison with the atmosphere and crosscurrents of about 30 m/sec on the ends of the suction zone could be measured. Similar but by far less pronounced pressure and current conditions therefore also in the present embodiments of the inventive device require that the discharge slot be definitively sealed, actually in the present case discharge slot 12 is sealed by total nonwoven fabric 7.

Coming back to suction surfaces "a" and "b" clearly shown in FIG. 1 it is to be stressed that the arc length of suction zone "b" is greater than that of suction zone "a." By this inventive concept it was advantageously achieved that the higher fiber layer in the area of suction surface "b" is compensated by the greater surface "b" there, for as can be seen in FIG. 1, the fiber layer increases in conveying direction 9. In this way, it is also possible to operate with lower suction pressures in comparison with the usual fall shafts, by which the crosscurrents above the forming nonwoven fabric are largely avoided.

It is also possible, as a mirror image to collecting conveyor unit 6 shown in FIG. 1, to provide a corresponding collecting conveyor unit instead of guide element 13.

Figure 2:
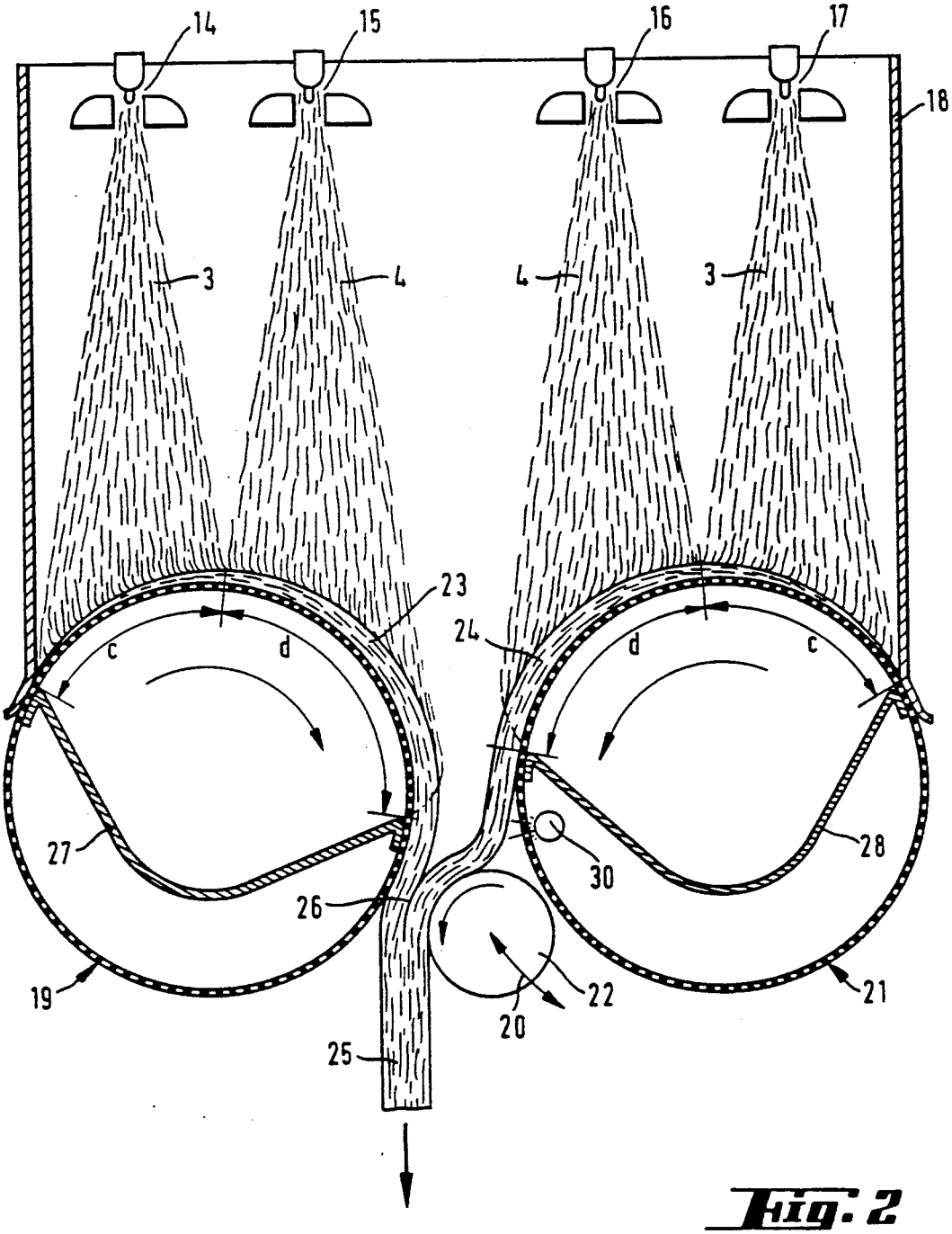
FIG. 2 is a diagrammatically simplified section through a second embodiment of a device according to the invention with four shredding units and two counterrotating collecting conveyors in the form of drums and a downstream adjustable sealing roller.

In FIG. 2 there is shown a diagrammatically simplified section through a second embodiment of a device according to the invention, actually with four shredding units 14 to 17, a fall shaft 18 and two collecting conveyors 19 and 21, drivable in opposite directions, in the form of drums and a downstream adjustable sealing roller 22, corresponding to arrow 20. With this device, a total nonwoven fabric 25 is continuously produced from two partial nonwoven fabrics 23 and 24, and drumlike collecting conveyors 19, 21 are placed at a fixed distance between axes to one another. Therefore since the clearance distance between the two collecting conveyors 19, 21 is also constant, roller 22 assumes the quasi function of an adjustable sealing device on the discharge slot identified by 26.

Here too it can clearly be seen that the suction surface at the beginning of the formation of partly nonwoven fabric 23, identified by "c," is smaller than the suction surface, identified by "d" in the area of the higher fiber layer of partial nonwoven fabric 23. These suction surfaces "c" and "d" can be variably adjusted especially in the area of discharge slot 26 to be able to obtain optimal discharge and suction conditions. This adjustability takes place, e.g., by a stator 27 provided inside drum 19, by which the suctioned and unsuctioned parts of the drum can be separated from one another. In this case the aim is that the two partial nonwoven fabrics 23 and 24 are brought together before the discharge. In principle collecting conveyor 21 is designed in a way similar to collecting conveyor 19, i.e., it also has a stator 28, with which, the suctioned and unsuctioned parts of the drum are separated from one another. Only the suctioned part ends here earlier than in the case of opposite collecting conveyor 19, since partial nonwoven fabric 24 as a result of sealing roller 22 must be removed from collecting conveyor 21 earlier. This removal can also be substantially facilitated by a blast device 30 represented diagrammatically in FIG. 2.

Figure 3:
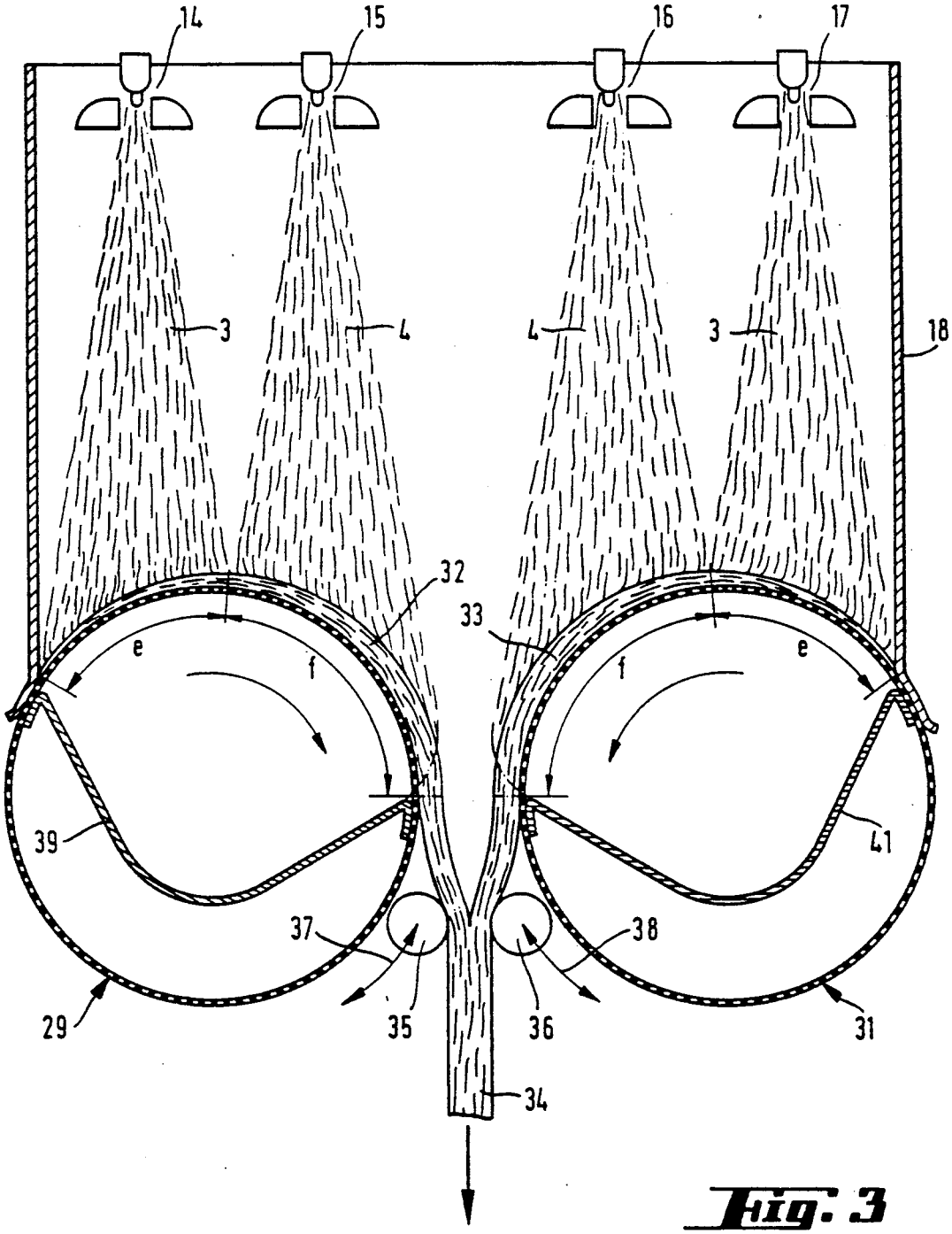
FIG. 3 is a diagrammatically simplified section through a third embodiment in a representation corresponding substantially to FIG. 2 with two adjustable sealing rollers downstream from the drums.

FIG. 3 also represents diagrammatically simplified a third embodiment with two drumlike collecting conveyors 29 and 31, with which partial nonwoven fabrics 32 and 33 are formed. In comparison with the device represented in FIG. 2, this device for continuous production of a mineral wool nonwoven fabric 34 differs only by the fact that the nonwoven fabric is formed by duo rollers 35 and 36 downstream in the conveying direction, and the latter are designed to be adjustable, which is indicated by arrows 37 and 38. According to the representation in FIG. 3 the duo rollers can be placed symmetrically but also unsymmetrically to collecting conveyors 29, 31.

Here also each collecting conveyor 29 or 31 has an inside stator 39 or 41, with which the suctioned or unsuctioned parts of the collecting conveyor can be adjusted. In the present case, with the two collecting conveyors 29, 31, the total suctioned surface each is equally large, and the available suction surfaces for the individual shredding units, identified by "e" and "f," again increase in the conveying direction.

Figure 4:
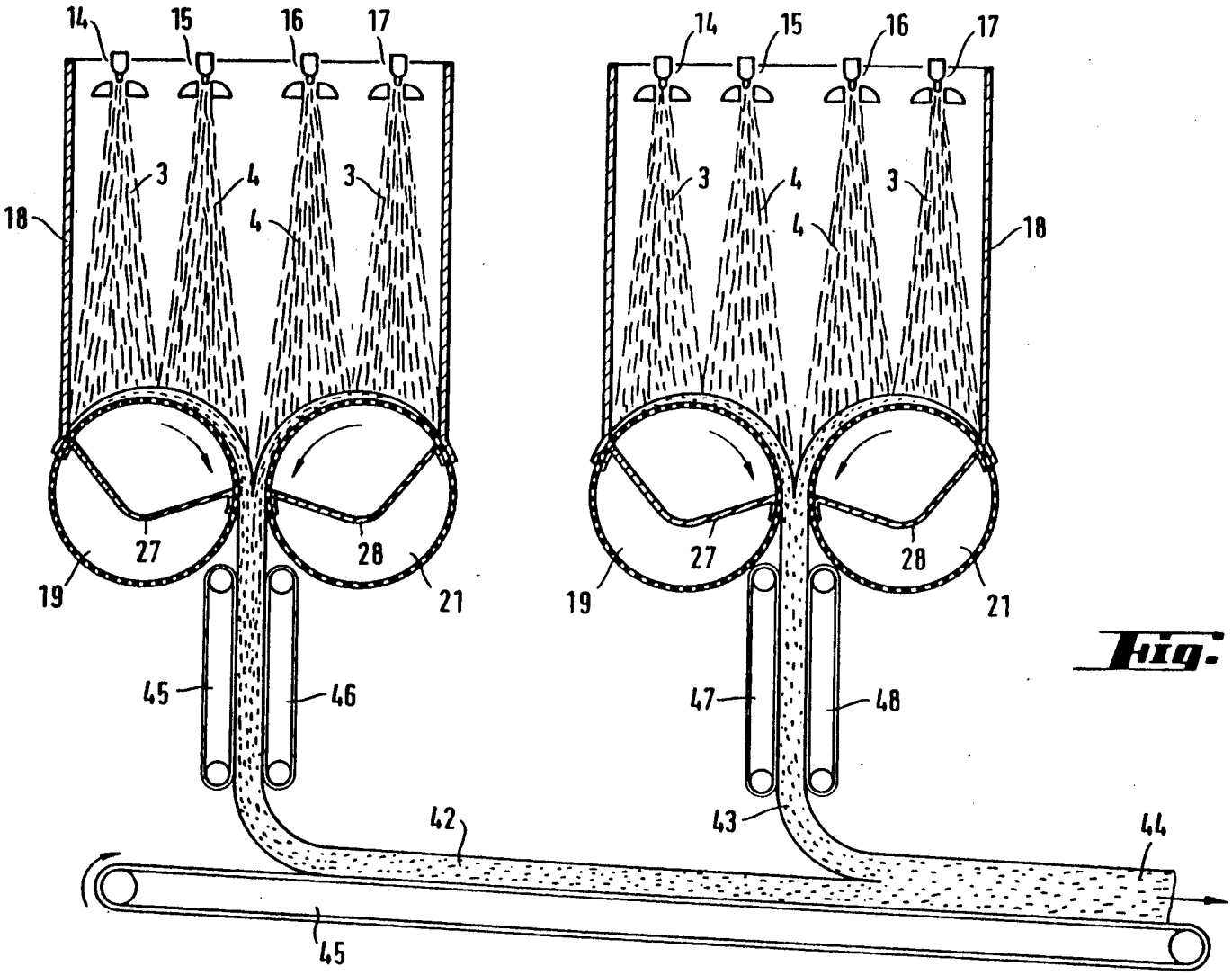
FIG. 4 is a diagrammatically simplified representation of two consecutively placed devices according to FIG. 3, but here as a fourth embodiment, instead of the rollers, two conveyor belts are each placed at a variable distance from one another, and the individual nonwoven fabrics are deposited together on a running production belt into a composite felt web.

For the case of a continuous production of a felt web 44 composed of several individual nonwoven fabrics 42 and 43 there are represented in FIG. 4 two consecutively placed devices according to FIG. 3, but which here as the fourth embodiment are equipped with two conveyor belts 45 to 48 each instead of with rollers 35, 36, whose distance from one another is variable. Especially with individual nonwoven fabrics with a relatively low bulk density, for example under 20 kg/m$^3$, conveyor belts 45 to 48 assume a certain guiding of the individual nonwoven fabric. It can clearly be seen from FIG. 4 how individual nonwoven fabric 42 as first deposited on running production belt 49 and then later individual nonwoven fabric 43 is deposited on this nonwoven fabric 42, so that total nonwoven fabric 44 results. This example can, of course, be extended in that other individual nonwoven fabrics can be added as layers.

Figure 5:
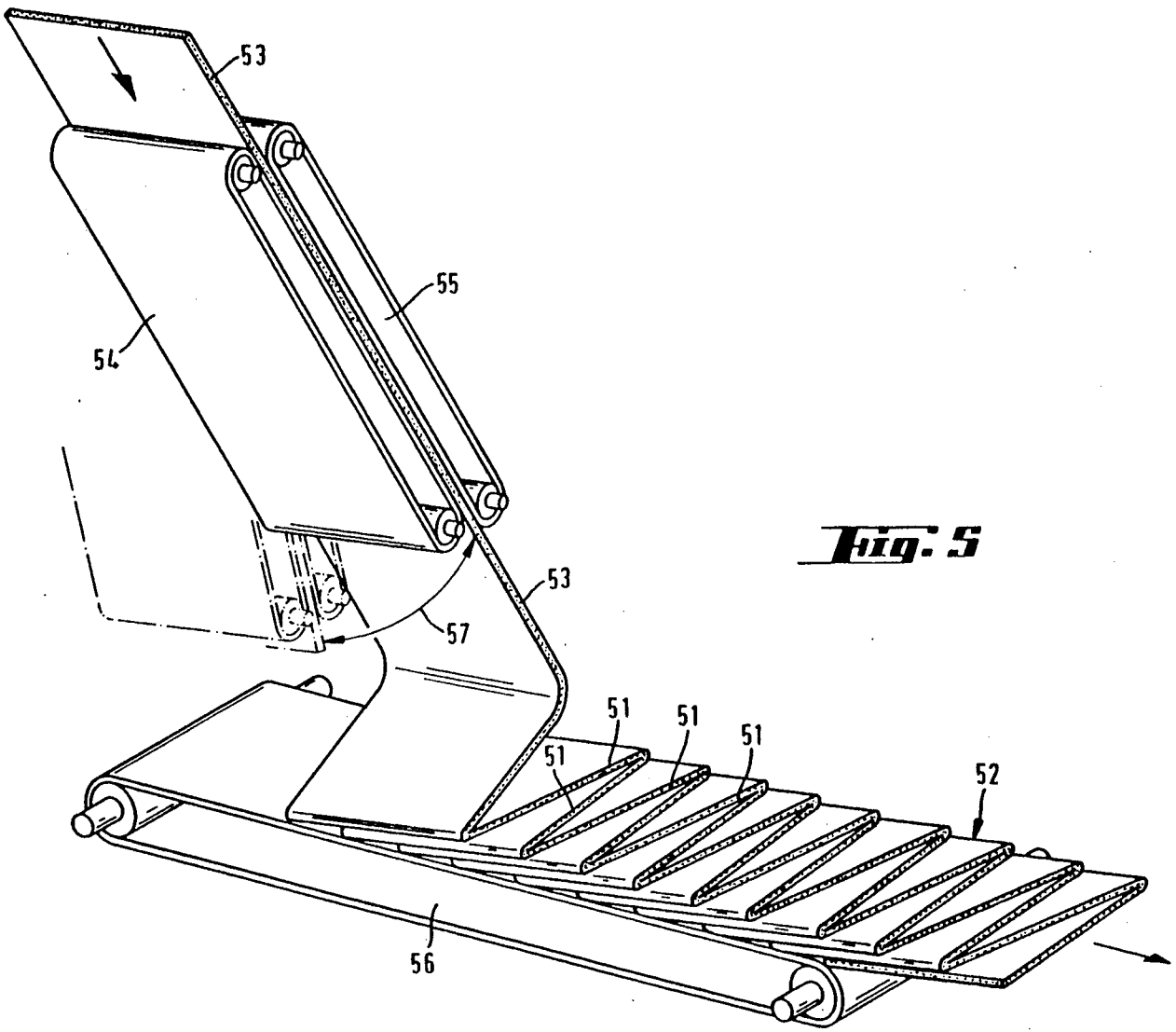
FIG. 5 is a perspective diagrammatic representative of a portion of the production line according to FIG. 4, but here a single nonwoven fabric by an oscillating movement of its guide conveyor belts is deposited on a running production belt into a composite felt web.

Finally, in FIG. 5 there is represented diagrammatically in perspective a cutout from a production line with which a composite felt web 52 is continuously produced from several nonwoven fabric layers 51. Individual nonwoven fabric layers 51 originate from a single nonwoven fabric 53 which, e.g., was produced corresponding to individual nonwoven fabric 42 in FIG. 4. Conveyor belts 54 and 55 placed here at a variable distance from one another in this case correspond to conveyor belts 45 and 46 in FIG. 4, while in this fifth embodiment conveyor belts 54 and 55 can make an oscillating movement to deposit individual nonwoven fabric 53 on a running production belt 56 into multilayer felt web 52. The mechanism, which puts conveyors belts 54 and 55 into an oscillating movement, is not represented in the drawing; rather, it is merely symbolically indicated only by double arrow 57.

Very generally the collecting conveyors of all five embodiments are each equipped with their own adjustable suction or, in the case of a common suction, with a corresponding throttle element which is able to react to possible idle shredding units and different requirements for the suction. Further, it is also possible that one collecting conveyor is acted on by more than two shredding units, since the concept according to the invention advantageously makes it possible to operate at relatively low suction energy with relatively high fiber layers.

Obviously, numerous additional modifications and variations of the present invention are possible in light of the above teachings. It is therefore to be understood that within the scope of the appended claims, the invention may be practiced otherwise than as specifically described herein.

We claim:

1. A process for the continuous production of mineral wool nonwoven fabrics comprising the steps of:

releasing fibers from first and second shredding units in a fall shaft;

subjecting the fibers to a suction pressure which attracts the fibers toward first and second deposit surfaces along a collecting conveyor advancing in a conveying direction;

depositing fibers from said first shredding unit onto said first deposit surface; and depositing fibers from said second shredding unit onto said second deposit surface, said second deposit surface having a length in said conveying direction longer than the length of the first deposit surface in said conveying direction.

2. A device for the continuous production of mineral wool nonwoven fabrics comprising:

a fall shaft;

a plurality of shredding units for releasing fibers into the fall shaft;

a first gas-permeable collecting conveyor unit adapted to move through the fall shaft along a path having a curved portion, said first conveyor unit being adapted to move in a conveying direction and being further adapted to attract fibers thereto by passing a suction gas therethrough;

a plurality of deposit surfaces on said first conveyor unit, one of said deposit surfaces corresponding to each of said plurality of shredding units;

wherein each of said deposit surfaces has a smaller suction surface area than a suction surface area of each deposit surface downstream thereof.

3. The device according to claim 2, further comprising:

a guide element placed at a clearance distance from the first conveyor unit and at a point opposite the curved portion of the path.

4. The device according to claim 3, wherein said guide element is movable in the conveying direction.

5. The device according to one of claims 3–4, wherein said clearance distance is adjustable.

6. The device according to claim 2, further comprising:

a second gas-permeable collecting conveyor unit separated by a slot from said first conveyor unit.

7. The device according to claim 6, wherein said plurality of shredding units comprises at least three shredding units.

8. The device according to claim 7, further comprising:

at least one adjustable element downstream of said second conveyor unit capable of varying the width of said slot.

9. The device according to claim 8, wherein said at least one adjustable element comprises a drivable roller.

10. The device according to claim 8, wherein said at least one adjustable element comprises a drivable conveyor belt.

11. The device according to claim 8, wherein said at least one adjustable element comprises two drivable rollers placed at a variable distance from one another.

12. The device according to claim 8, wherein said at least one adjustable element comprises two drivable conveyor belts placed at a variable distance from one another.

13. The device according to claim 6, wherein a total suction surface area of each collecting conveyor unit is adjustable.

14. The device according to claim 2, wherein said shredding units are shredding units operating according to a blast drawing process.

15. The device according to claim 14, wherein the shredding units are inclined so that the fibers produced by them strike the collecting surfaces at an inclination deviating from the vertical.

16. The device according to claim 6, wherein at least one collecting conveyor unit is designed as a drum.

17. The device according to claim 6, wherein the suction pressure in each collecting conveyor unit is independently adjustable.

18. A process for the continuous production of a felt web comprising a plurality of individual nonwoven fabric layers, said process comprising the steps of:

releasing fibers from a downstream fiber source and an upstream fiber source into a first fall shaft;

attracting fibers in said first fall shaft to a first suction surface using a suction pressure, said first suction surface having a curved portion such that a suction surface area acting on fibers released from said downstream fiber source is greater than a suction surface area acting on fibers released from said upstream fiber source;

guiding a first nonwoven fabric from said first fall shaft;

releasing fibers from a downstream fiber source and an upstream fiber source into a second fall shaft;

attracting fibers in said second fall shaft to a second suction surface using a suction pressure, said second suction surface having a curved portion such that a suction surface area acting on fibers released from said downstream fiber source is greater than a suction surface area acting on fibers released from said upstream fiber source;

guiding a second nonwoven fabric from said second fall shaft; and depositing said first and second nonwoven fabrics together onto a running production belt.

19. A process for the continuous production of a multilayer felt web comprising a plurality of individual nonwoven fabric layers, said process comprising the steps of:

releasing fibers from a downstream fiber source and an upstream fiber source into a fall shaft;

attracting fibers in said fall shaft to a suction surface using a suction pressure, said suction surface having a curved portion such that a suction surface area acting on fibers released from said downstream fiber source is greater than a suction surface area acting on fibers released from said upstream fiber source;

guiding a nonwoven fabric from said fall shaft to a running production belt with a pair of rotating conveyor belts; and oscillating said pair of rotating conveyor belts in a direction perpendicular to a direction of advancement of said running production belt to produce said multilayer felt web.

* * * * *